US005127170A

United States Patent [19]

Messina

[11] Patent Number: 5,127,170

[45] Date of Patent: Jul. 7, 1992

[54] COLLAPSIBLE ATHLETIC SHOE

[76] Inventor: Robert Messina, 637 Promontory Dr. West, Newport Beach, Calif. 92658

[21] Appl. No.: 461,247

[22] Filed: Jan. 5, 1990

[51] Int. Cl.[5] ..... A43B 21/00

[52] U.S. Cl. ..... 36/105; 36/58.6; 36/68; 36/69

[58] Field of Search ..... 36/68, 69, 58.6, 105, 36/106, 28, 1

[56] References Cited

U.S. PATENT DOCUMENTS

| | | | |
|---|---|---|---|
| 1,064,923 | 6/1913 | McCoy | 36/68 |
| 2,299,831 | 10/1942 | Lyon | 36/25 R |
| 2,353,829 | 7/1944 | Jakosky | 36/25 R |
| 2,418,342 | 4/1947 | Freedman | 36/1 |
| 2,446,777 | 8/1948 | Menenko | 36/1 |
| 2,897,609 | 8/1959 | Bodkin | 36/1 |
| 3,146,535 | 9/1964 | Owings | 36/58.6 |
| 3,192,651 | 7/1965 | Smith | 36/105 |
| 3,337,972 | 4/1965 | Stollman | 36/1 X |
| 4,095,356 | 6/1978 | Robran et al. | 36/105 |
| 4,503,628 | 3/1985 | Mancinelli et al. | 36/68 |
| 4,575,958 | 3/1986 | Arieh et al. | 36/105 |
| 4,594,798 | 6/1986 | Autry et al. | 36/69 |
| 4,761,899 | 8/1988 | Marxer | 36/105 |
| 4,783,909 | 11/1988 | Van Doren et al. | 36/69 |

FOREIGN PATENT DOCUMENTS

| | | | |
|---|---|---|---|
| 2461701 | 11/1976 | Fed. Rep. of Germany | 36/105 |

*Primary Examiner*—David T. Fidei
*Assistant Examiner*—Ted Kavanaugh

[57] ABSTRACT

A new athletic shoe is disclosed suitable for packing in small suitbags or luggage for travel. A moveable or a detachable heel portion of the upper of the shoe allows the remainder of the upper to be collapsed to form a thinner shoe. Further, flexible soles may be used with inserts for providing rigidity, thereby allowing the toe of the shoe to be flexed back to the heal of the shoe allowing for a shorter, more compact structure for storage.

1 Claim, 4 Drawing Sheets

COLLAPSIBLE ATHLETIC SHOE

BACKGROUND OF THE INVENTION

1. Field of the Invention

This invention relates to athletic footwear and more particularly relates to athletic footwear that may be readily collapsed into a thin or compact package to allow for storage during transportation.

2. Description of the Prior Art

Many business people and other travelers often desire to exercise by running or using athletic clubs or gyms while traveling. Such travelers frequently desire to be able to transport a pair of high quality running shoes or athletic shoes with them such as those offered by Reebok and called "Cross Trainers" because they are designed to allow the wearer to run, to bicycle, to participate in aerobics and to partake in other forms of exercise.

However, current running shoes and other better athletic shoes are large, bulky, and heavy. These shoes have thick, soles that have been hardened to provide foot support to the runner or exerciser. They also frequently include substantial padding to absorb the shocks from running on hard ground or from exercising on wooden aerobics floors. In addition the upper, which is the portion of the shoe above the sole, is also made of a thicker material. In particular, the heels of such shoes usually have rigid supports that prevent collapsing the uppers to form a thinner profile for packing. Nor can the soles be readily bent to allow the shoe to be formed into a compact, shorter package.

Thus, for a business traveler who wishes to travel with only one bag, bringing a pair of better quality athletic shoes such as those offered by Nike, Reebok or Addidas is undesirable. Of course, buying a pair of better quality athletic shoes to throw out after a short business trip may be prohibitively expensive as such shoes often cost more than $100 per pair.

An alternative solution is to purchase a pair of lower quality sneakers, which have a thin sole and canvas uppers that lack a rigid heel portion and provide less support than better quality shoes. Such lower quality sneakers can be more readily transported but are generally considered inadequate for substantial running or other vigorous athletic activities such as aerobics. Such lower quality sneakers generally fail to provide adequate foot support and wear out readily.

Thus, it is a first object of the instant invention to provide an athletic shoe that is reasonably priced, relatively light, and may be collapsed into a thinner profile or a more compact package suitable for transportation in a small suitcase or garment bag. It is a further object of the instant invention to provide an athletic shoe that provides sufficient support for activities such as running and aerobics.

SUMMARY OF THE DISCLOSED INVENTION

These and other objects are overcome by the several different embodiments of new athletic shoe disclosed herein having a moveable, rigid heel portion in the upper or a separate heel piece. In a first, upright position, the heel portion or piece provides rigid support while in a second detached position or in a horizontal position, the remainder of the upper may be readily collapsed to form a flattened shoe with a relatively thin profile.

A further improvement is the inclusion in the shoe of a removable support means to allow the entire shoe to be folded into a shorter, compact structure. The removable support may consist of a series of removable rods extending the length of the sole formed of metal or other suitably rigid material inserted through preformed horizontal channels in the sole of the shoe. Alternatively, a preformed, removable rigid insert may be placed inside the shoe between a removable padded inner sole and the outside sole of the shoe.

DETAILED DESCRIPTION OF THE PREFERRED EMBODIMENTS

Figure 1:
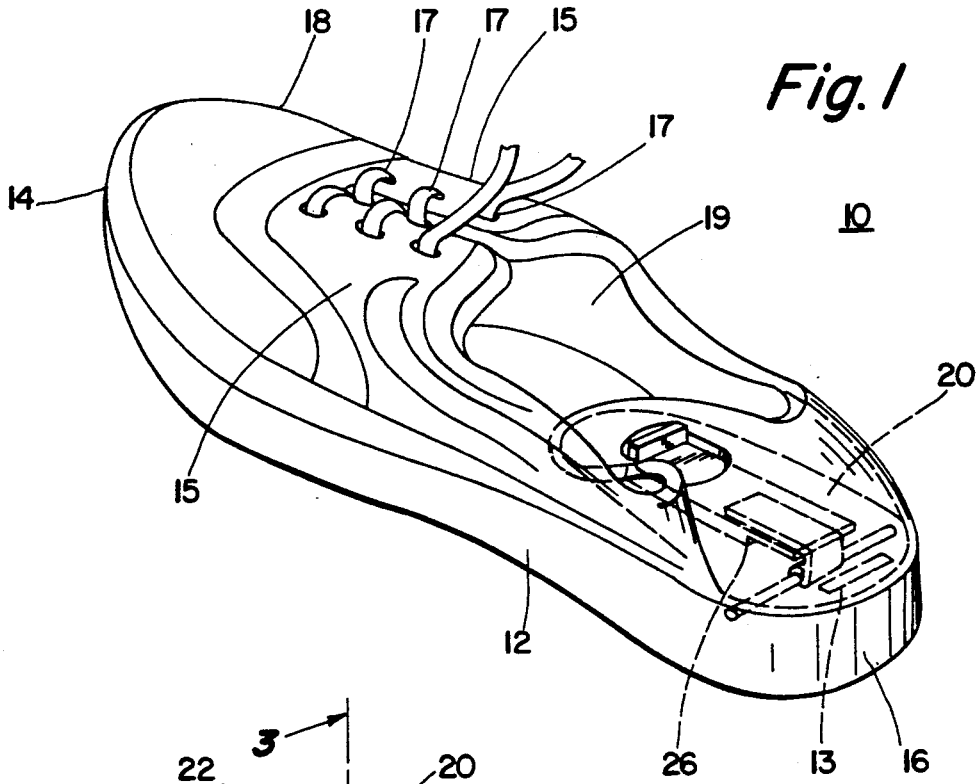
FIG. 1 is a perspective view of one embodiment of the instant invention with a moveable heel portion in the horizontal position so that the upper may be collapsed.

FIG. 1 shows a perspective view of a first embodiment 10 of the instant invention. The shoe includes an elongated support sole 12 made from a relatively rigid rubber-like substance or blend of substances such as those commonly found in better quality running and athletic shoes. The sole may also include a relatively resilient, compressible material such as urethane or have air pockets to form a shock absorbing layer (not shown) in the sole. A common type of sole that may be used can be multilayered, for example, a bottom layer of a carbon rubber and an upper layer designed for shock absorption made of ethyl vinyl acetate. The support sole 12 is formed in the general shape of the bottom of a foot, and includes a front or toe portion 14 and a rear or heel portion 16.

Secured to the sole 12 is a thickened upper 18 similar to uppers common among better athletic shoes. The upper 18 may be made of a synthetic leather such as ecsaine, of a natural leather or of nylon. The upper 18 defines a heel opening 19, lace holes 17, a tongue (not shown), and flaps 15 and the upper 18 is coupled to the sole around the entire periphery of the sole 12. The shape of the upper 18 generally conforms to the shape of a foot and may be secured to the sole by stitching, glue, or other common means used in the athletic shoe industry. The upper may be made of synthetic substances such as rubber or plastics or leather or a combination of any such material and typically includes a flexible outer skin and interior padding, thereby forming a thickened upper sole.

Figure 2:
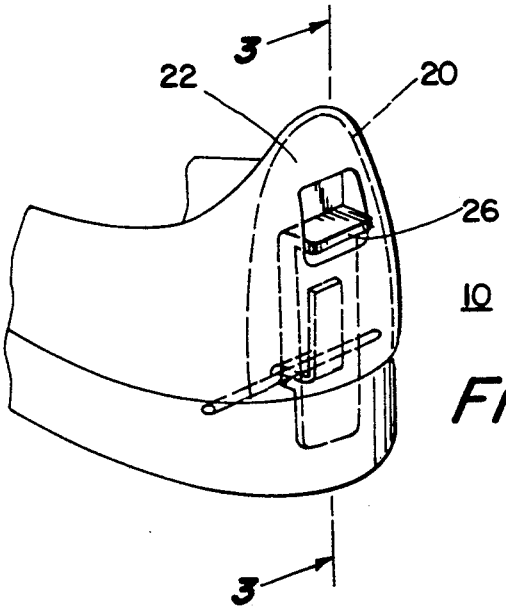
FIG. 2 is a partial perspective view of the embodiment of FIG. 1 with the heel portion in the upright position.
Figure 3:
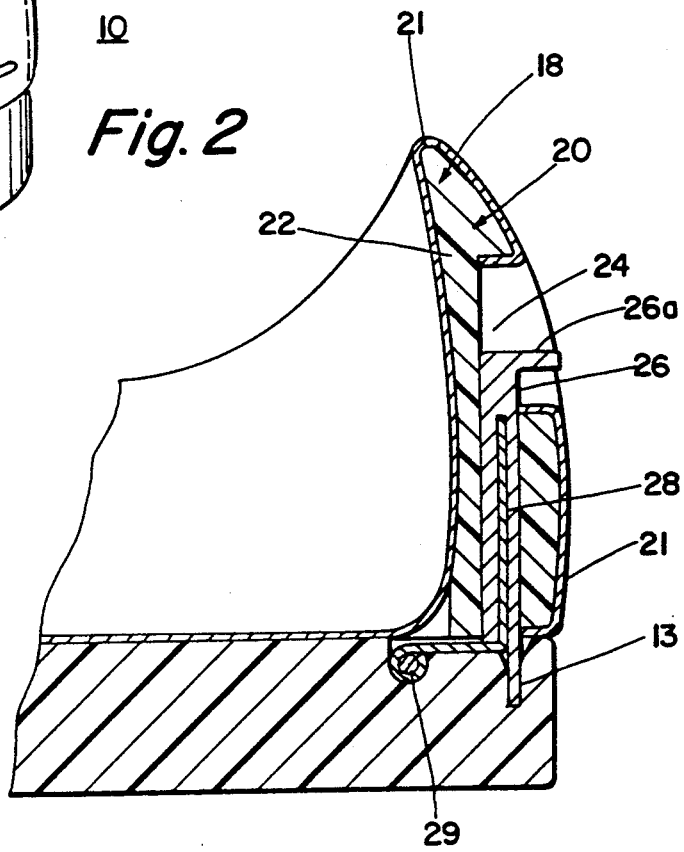
FIG. 3 is a partial sectional view taken along line 3—3 in FIG. 2 with the heel portion in the upright position.
Figure 4:
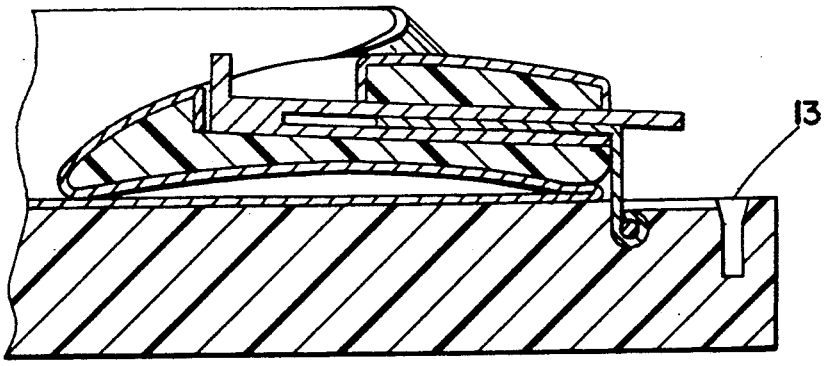
FIG. 4 is another partial sectional view taken along line 3—3 with the heel portion in the horizontal position.

Also included in the upper 18 is an elongated heel portion 20 that is moveable between an upright position (FIGS. 2 and 3) and a horizontal or lowered position (FIGS. 1 and 4). In the upright position, the direction of elongation of the heel portion is substantially perpendicular to the direction of elongation of the sole. In the horizontal or lowered position, the direction of elongation of the heel portion is approximately parallel to the direction of elongation of the sole. In the upright position, a foot may be inserted into the heel opening 19 and the shoe 10 will act like a normal running or athletic shoe. However, with the heel portion pivoted in the horizontal position as shown in FIG. 1, the entire upper 18 may be collapsed (not shown) to provide a more compact structure for transport. This more compact structure is suitable for allowing storage of the shoes in an overnight bag or a small suitcase.

Included in the heel portion 20 is a relatively rigid member 22 that provides a relatively rigid heel portion for good fit and heel support while the shoe 10 is in use. The rigid member 22 may also include padding.

The heel portion 20 also defines a slot 24 that is vertical in the upright position and that also opens to the exterior in the rear. Partially slidably disposed within the slot 24 is a moveable member 26 that is partially housed within a slot 13 defined in the sole when the heel portion is 20 in the upright position. The moveable member 26 also defines a tab or ridge 26*a* that is adapted to engage a finger for pushing and pulling the member 26. Partially slidably disposed within the moveable member 26 is an "L" shaped piece that is attached to a pivot member 29 secured to the sole 12. The pivot member 29 may be secured to the sole by glue, by a compression fit or through bolts (not shown). The heel portion 20 and the remainder of the sole 18 includes a flexible outer skin 21.

To wear the disclosed athletic shoe 10, the heel portion 20 is moved to the upright position and the moveable member is pushed towards the sole until the member 26 engages with and is partially disposed in the slot 13 in the sole. To store the athletic shoe in a suitcase or other container, the slidable member 26 is pulled or retracted from the slot 13 and the heel portion 20 is pivoted towards the sole into a horizontal position. After the heel portion has been pivoted, the remainder of the upper 18 may be collapsed or flattened forming a structure having a thinner profile than an ordinary athletic shoe. Rubber bands or closure straps (not shown) may then be used to retain the upper 18 in the collapsed or flattened position.

Figure 5:
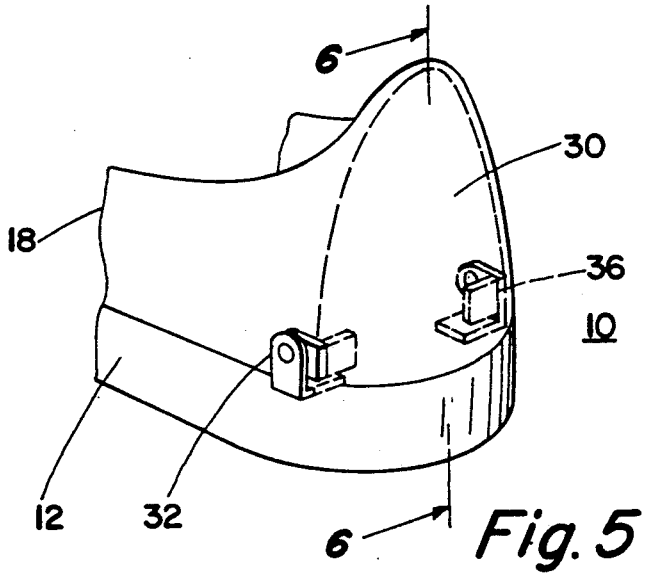
FIG. 5 is a partial perspective view of an alternative embodiment of the instant invention.
Figure 6:
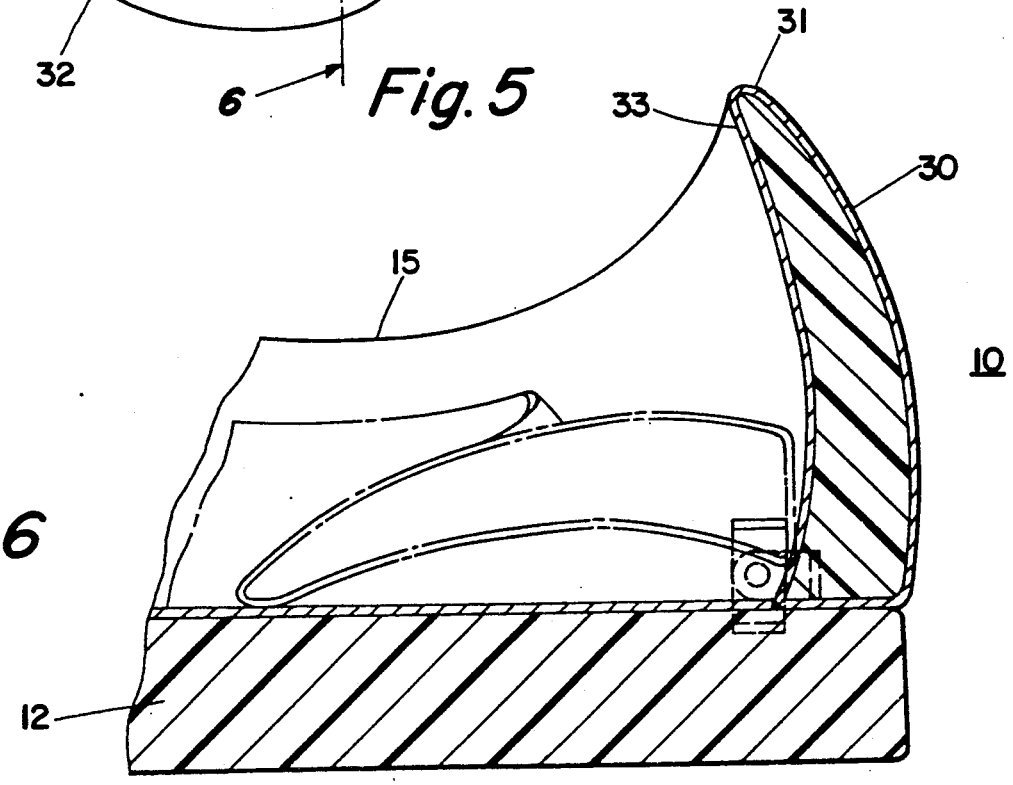
FIG. 6 is a partial sectional view taken along line 6—6 in FIG. 5 and showing the heel portion in phantom in the horizontal position.
Figure 8:
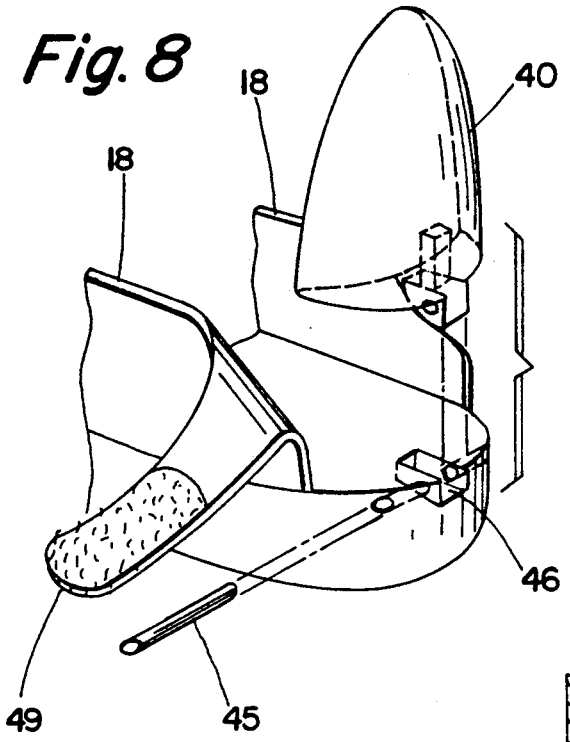
FIG. 8 is a partial perspective exploded view of the same embodiment.

FIGS. 5 and 6 disclose a second embodiment of the invention 10 with a different structure for providing collapsing of the upper 18. Virtually all of the sole 12 and virtually all of the upper 18 are identical to the sole 12 and the upper 18 of the other embodiments except near the heel of the shoe.

A heel portion 30 includes a rigid internal member 33 and a flexible skin 31. Two pivot structures 32 and 36 comprise of "L" shaped pieces pivotally joined secure the heel portion 30 to the sole. One "L" shaped piece of each structure is joined to the sole 18 and the other "L" shaped piece is secured to the heel portion 30. The L shaped pieces may be joined to the sole and the upper by glue, rivets, a force fit or other well known securement means. To collapse the shoe into the lowered profile, the top of the heel portion 30 is pivoted towards the toe of the shoe, allowing the remainder of the upper to be collapsed in the same manner that the upper of the first embodiment may be collapsed. The "L" shaped pieces may include locking means such as pawls and notches and or spring mechanisms (not shown) that allow the heel portion 30 to be secured in the vertical or the horizontal position.

FIGS. 7, 8, 9 and 10 show a third embodiment of the invention. Except for a separate heel piece 40 and the securement means for that heel piece in the sole, the remainder of the shoe is identical to the corresponding portions of the shoe shown in FIG. 1.

Figure 7:
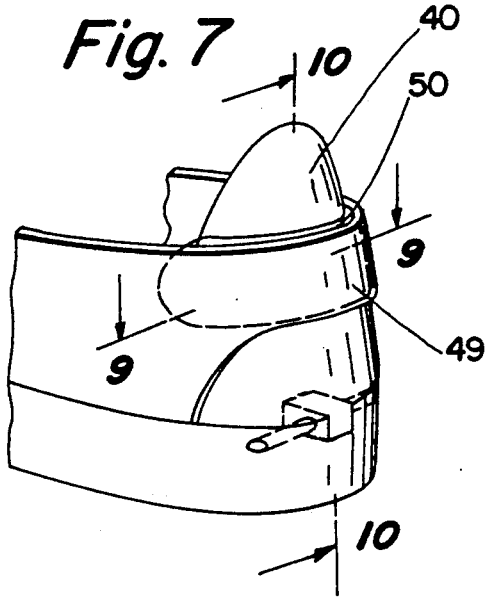
FIG. 7 is a partial perspective view of a third embodiment of the invention using a separate heel piece.
Figure 9:
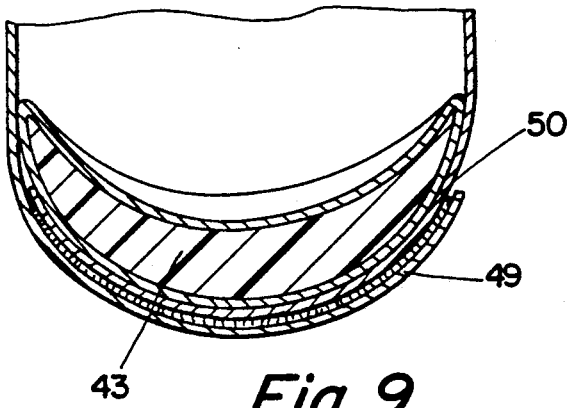
FIG. 9 is a partial sectional view taken along line 9—9 in FIG. 7.

In this third embodiment, the heel piece 40 constitutes a separate piece and is not attached to the remainder of the upper 18. The heel piece includes a rigid internal member 43 and has a tab 42 designed to extend into a matching, curved groove 46 formed in the sole 12 to secure the heel piece in the vertical position. A pin 45 is inserted through guide holes 47 defined in the sole 18 to secure the heel piece 40 in the upright position. Two strips 49 and 50 that may be formed as part of the skin of the upper and project towards the heel of the shoe to secure the heel piece 40 in an upright position as shown in FIG. 7. The two strips 49 and 50 should be secured to each other and the heel piece 40 by velcro strips or other suitable, detachable securing means such as snaps.

Figure 10:
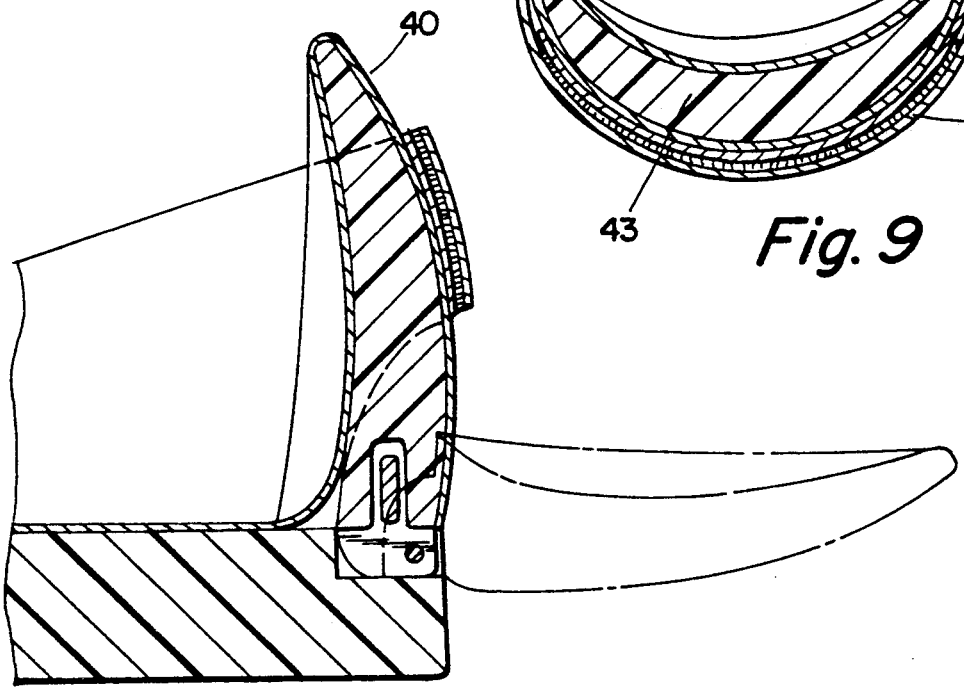
FIG. 10 is a partial sectional view taken along line 10—10 in FIG. 7.

To collapse this last embodiment for storage, the pin 45 may be removed and the two strips 49 and 50 may be detached from each other, allowing separation of the heel piece 40 from the sole 12. Then the remainder of the upper 18 may be collapsed. The two strips 49 and 50 may be used to secure the shoe 10 to the other member of the pair of shoes. Alternatively the heel piece 40 may be pivoted from the upright position as shown in FIG. 10, allowing the upper 18 to be collapsed.

Figure 11:
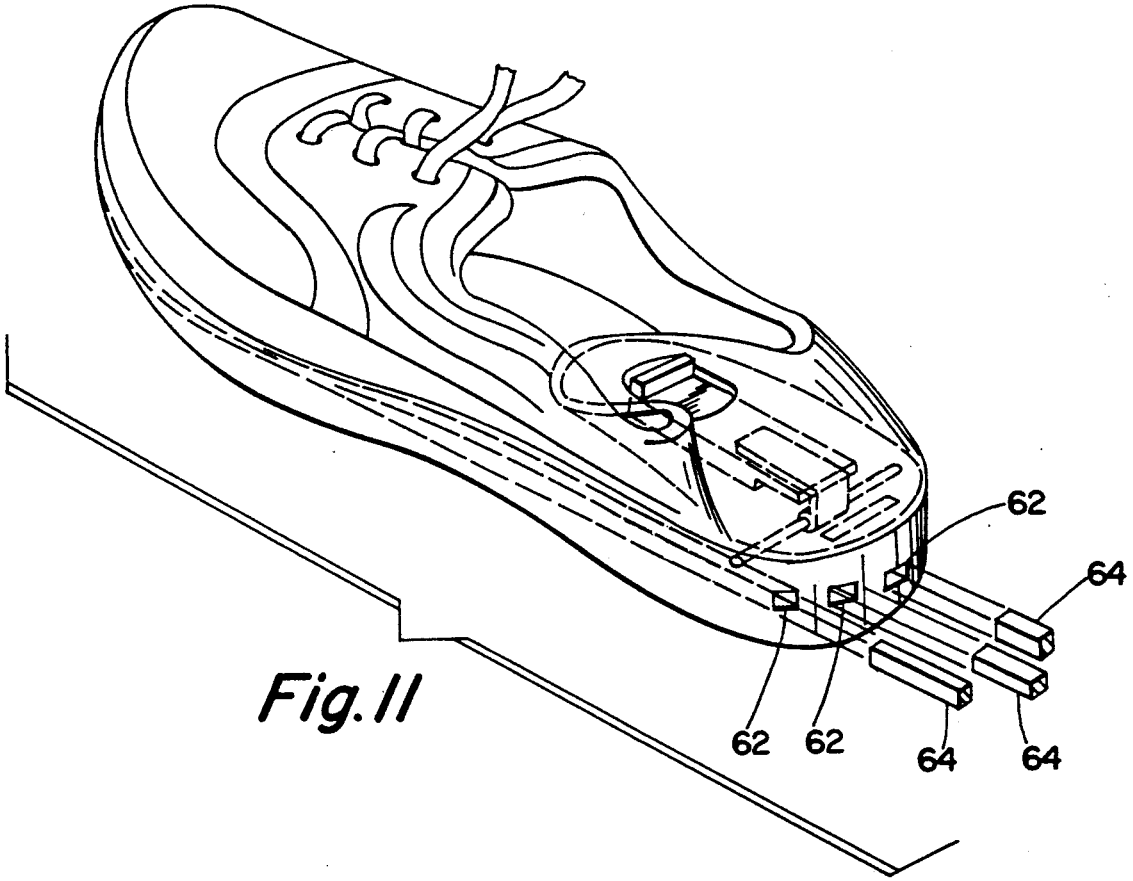
FIG. 11 is an additional embodiment that has removable rigid support rods for insertion into channels shown in phantom in the sole of the shoe.

An additional feature of the instant invention is shown in FIG. 11. Instead of using a support sole 12 made of a harder rubber, the support sole 60 may be made of a flexible material such as a soft urethane. To provide foot support, The sole 60 further defines channels 62 and pins 64 (partial sections being shown) made of a rigid plastic or metal are inserted to provide the desired support. When wearing the shoes, the pins 64 are inserted into the channels. The pins when inserted extend virtually the entire length of the shoe. However, for storage, the pins 64 are removed, allowing the toe portion of the shoe to be folded back towards the heel. Folding the heel allows for a shorter, more compact structure during storage. Although the use of removable pins 64 are shown in use with the first embodiment, the pins 64 and channels 62 may be used in any of the other alternative embodiments disclosed. Further, instead of using the pins 64 and channels 62, a rigid, removable support insert (not shown) that fits underneath padding inside the shoe may also be used.

Thus, an athletic shoe that can form either a more compact or a thinner, collapsible profile has been disclosed. The athletic shoe provides good support but also may be easily stored.

Further, it should be understood that the foregoing embodiments are illustrative only. For an understanding of the true scope of the invention, the claims should be studied.

I claim:

1. An athletic shoe comprising a support sole conforming to the shape of the foot, the sole including a front portion shaped to conform to the toes of the foot and a rear portion shaped to conform to the heel of the foot, said sole including a vertical slot near the rear periphery of the sole, a collapsible thickened upper conformed to the shape of the sole and secured to the sole and substantially surrounding a foot inserted into the shoe, said upper portion including a heel portion, said heel portion having a slot therein, said heel slot being vertically aligned with said sole slot, said slots having an elongated member contained therein, said member being pivotally connected to said sole at a pivot member forward of said sole slot, whereby when the heel portion is desired to be collapsed, the elongated member is raised in said heel slot to extend above the sole slot and pivoted about said pivot member so as to engage the upper rear portion of the sole.

* * * * *